US009776845B2

(12) United States Patent
Minke

(10) Patent No.: US 9,776,845 B2
(45) Date of Patent: Oct. 3, 2017

(54) AERIAL LIFT PLATFORM WITH DIELECTRIC ANCHOR

(71) Applicant: COMPOSITES SYNDICATE PR, LLC, Fort Wayne, IN (US)

(72) Inventor: Ronald C. Minke, Fort Wayne, IN (US)

(73) Assignee: Composites Syndicate PR, LLC, Fort Wayne, IN (US)

( * ) Notice: Subject to any disclaimer, the term of this patent is extended or adjusted under 35 U.S.C. 154(b) by 0 days.

(21) Appl. No.: 15/134,744

(22) Filed: Apr. 21, 2016

(65) Prior Publication Data

US 2016/0368738 A1 Dec. 22, 2016

Related U.S. Application Data

(60) Provisional application No. 62/180,210, filed on Jun. 16, 2015.

(51) Int. Cl.

| | |
|---|---|
| ***B66F 11/04*** | (2006.01) |
| ***A62B 35/00*** | (2006.01) |
| ***B66F 17/00*** | (2006.01) |

(52) U.S. Cl.

CPC ..... *B66F 11/044* (2013.01); *A62B 35/0068* (2013.01); *B66F 11/04* (2013.01); *B66F 17/006* (2013.01)

(58) Field of Classification Search

CPC ..... B66F 17/006; B66F 11/044

See application file for complete search history.

(56) References Cited

U.S. PATENT DOCUMENTS

| | | | | |
|---|---|---|---|---|
| 3,022,854 | A | 2/1962 | Eckels et al. | |
| 3,035,799 | A | 5/1962 | Peirce | |
| 3,191,716 | A | 6/1965 | Eitel | |
| 3,440,707 | A | 4/1969 | Pittsford et al. | |
| 3,625,305 | A * | 12/1971 | Mueller | B66F 11/044 182/2.4 |
| 3,642,096 | A * | 2/1972 | Valentine | B66F 11/044 182/2.11 |
| 3,845,596 | A * | 11/1974 | Veenstra | B66C 23/701 182/141 |
| 4,254,846 | A * | 3/1981 | Soave | B65D 25/18 182/2.4 |
| 4,883,145 | A * | 11/1989 | Deltatto | B66F 11/044 182/2.4 |
| 6,265,983 | B1 * | 7/2001 | Baillargeon | A62B 35/0037 340/673 |
| 6,330,931 | B1 * | 12/2001 | Baillargeon | A62B 35/0037 182/18 |

(Continued)

OTHER PUBLICATIONS

Howland, Rick, "Can Operator Safety be Engineered for Aerial Lifts?", Tree Care Industry, Apr. 2015.

*Primary Examiner* — Katherine Mitchell
*Assistant Examiner* — Marcus Menezes
(74) *Attorney, Agent, or Firm* — Faegre Baker Daniels LLP

(57) ABSTRACT

An anchoring assembly is provided for the aerial lift platform of an aerial lift vehicle. The anchor assembly extends through the walls of a bucket liner and a bucket platform, and provides a strong anchor disposed inside of the bucket liner for use in attaching an operator harness to prevent the operator from being ejected from the bucket platform. The anchor assembly also provides dielectric protection mandated by OSHA and ANSI standards.

20 Claims, 5 Drawing Sheets

(56) References Cited

U.S. PATENT DOCUMENTS

| | | | | |
|---|---|---|---|---|
| 8,899,380 | B2 * | 12/2014 | Chard | B66F 17/006 182/129 |
| 9,149,670 | B1 * | 10/2015 | Walker | A62B 35/0068 |
| 9,492,693 | B2 * | 11/2016 | Byrd | A62B 35/0068 |
| 2003/0182893 | A1 * | 10/2003 | Poldmaa | A62B 35/0068 52/745.21 |
| 2010/0187040 | A1 * | 7/2010 | Siemienowicz | A62B 1/04 182/3 |
| 2014/0138183 | A1 * | 5/2014 | Chard | B66F 17/006 182/46 |
| 2016/0280525 | A1 * | 9/2016 | Higgins | B66F 11/046 |

* cited by examiner

AERIAL LIFT PLATFORM WITH DIELECTRIC ANCHOR

CROSS REFERENCE TO RELATED APPLICATIONS

This application claims the benefit under Title 35, U.S.C. §119(e) of U.S. Provisional Patent Application Ser. No. 62/180,210, entitled AERIAL LIFT PLATFORM WITH DIELECTRIC ANCHOR, filed on Jun. 16, 2015, the entire disclosure of which is expressly incorporated by reference herein.

BACKGROUND

2. Field of the Disclosure

The present disclosure relates to an aerial lift platform for use with an aerial lift vehicle, the platform including a dielectric anchor.

3. Description of the Related Art

Aerial lift platforms are used by utility companies, arborists and others to allow an operator to safely work at an elevated position. The platforms typically include a semi-enclosed "bucket" structure made of a dielectric material, such as fiberglass or plastic, or of an electrically conductive material, such as a metal or metal alloy, which is attached to the end of the lifting boom of an aerial lift vehicle. In order to provide protection from electrical shock to an operator within the bucket, the bucket may be fitted with an internal electrically insulating bucket liner. The dielectric integrity of the bucket liner requires a continuous, uninterrupted enclosure to provide electrical shock protection for the operator, wherein any open holes, fractures, cracks, or thin wall portions can potentially result in dielectric failure of the bucket liner. Notwithstanding the foregoing potential for dielectric failure, bucket liners are a well proven, and often required, piece of safety equipment in particular applications.

In addition to the danger of potential exposure to electric shock, operators of aerial lift platforms also face the risk of being ejected from the bucket while working in an elevated position. For example, an external object striking the aerial lift vehicle may cause a may result in the operator being ejected from the bucket. In order to mitigate this risk, many harness/lanyard and fall arresting devices are currently available, which require an attachment point to a strong anchor point, typically a location on the lifting boom of the aerial lift vehicle. The length of the lanyards and the design of the harnesses are intended to minimize injury to the operator if the operator is ejected from the bucket. However, the use of these devices is somewhat cumbersome, and requires a varying degree of proper installation for correct function. Additionally, even when these devices function correctly, the experience of being ejected from the bucket while at an elevated height is traumatic for the operator.

What is needed is an improvement over the foregoing.

SUMMARY

The present disclosure provides an anchoring assembly for the aerial lift platform of an aerial lift vehicle, which provides a strong anchor point disposed inside of a bucket liner for preventing an operator from being ejected from the bucket, and also provides dielectric protection mandated by OSHA and ANSI standards.

In one form thereof, the present disclosure provides a platform for use with an aerial lift vehicle, including a bucket including a first bottom wall and at least one first side wall, and a first hole in one of the first bottom wall and the first side wall; a bucket liner received within the bucket, the bucket liner including a second bottom wall and at least one second side wall, and a second hole in one of the second bottom wall and the second side wall, the second hole in alignment with the first hole; and an anchor assembly extending through the first and second holes, the anchor assembly including an anchor point disposed internally within the bucket liner; and a cover assembly disposed externally of the bucket.

In another form thereof, the present disclosure provides a platform for use with an aerial lift vehicle, including a bucket including a first bottom wall and at least one first side wall, and a first hole in one of the first bottom wall and the first side wall; a bucket liner received within the bucket, the bucket liner including a second bottom wall and at least one second side wall, and a second hole in one of the second bottom wall and the second side wall, the second hole in alignment with the first hole; and an anchor assembly extending through the first and second holes, the anchor assembly including an anchor point disposed internally within the bucket liner, the anchor point including a shaft extending through the aligned first and second holes, the shaft having an end disposed externally of the bucket.

In a further form thereof, the present disclosure provides a bucket liner for use with a platform of an aerial lift vehicle, including a bottom wall and at least one side wall, and a hole in one of the bottom wall and the side wall; and an anchor assembly extending through the hole, the anchor assembly including an anchor point disposed within the bucket liner; and a cover assembly disposed externally of the bucket liner.

BRIEF DESCRIPTION OF THE DRAWINGS

The above mentioned and other features and objects of this disclosure, and the manner of attaining them, will become more apparent and the disclosure itself will be better understood by reference to the following description of embodiments of the disclosure taken in conjunction with the accompanying drawings, wherein.

Figure 1:
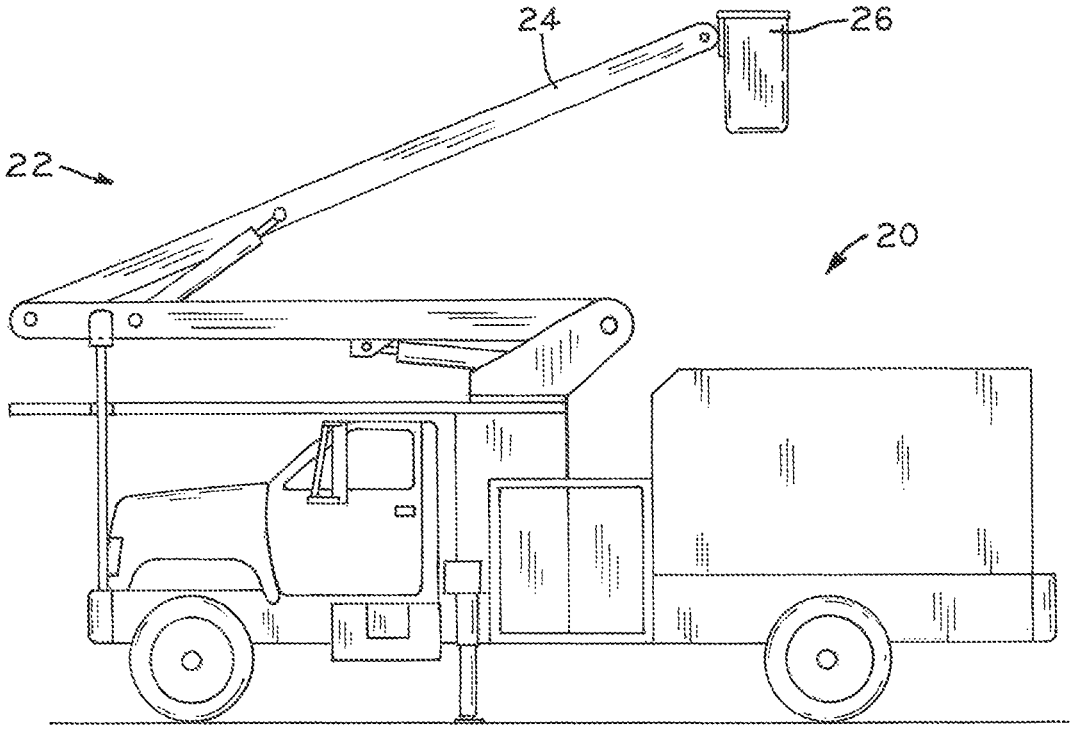
FIG. 1 is a side view of an aerial lift vehicle including a lifting boom and platform including a bucket.

Corresponding reference characters indicate corresponding parts throughout the several views. Although the exemplifications set out herein illustrate embodiments of the disclosure, the embodiments disclosed below are not intended to be exhaustive or to be construed as limiting the scope of the disclosure to the precise form disclosed.

DETAILED DESCRIPTION

Referring to FIG. 1, an aerial lift vehicle 20 is shown in the form of an aerial lift truck, which includes a lifting boom assembly 22 having a boom arm 24 for supporting platform 26 at a selected elevated position to enable an operator to perform various tasks at an elevated height, such as servicing or installing electrical power lines, servicing or installing data transmission equipment, or trimming trees, for example.

Figure 2:
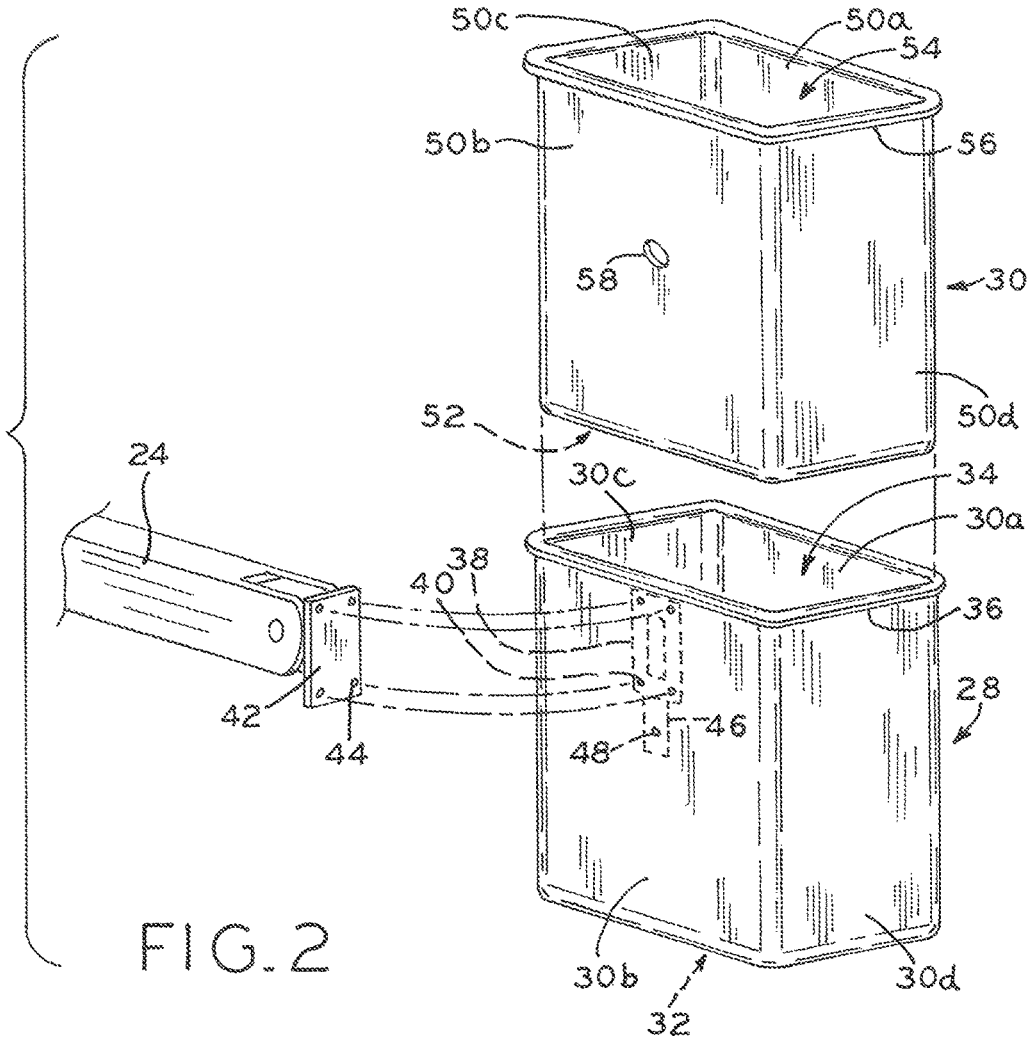
FIG. 2 is a partial perspective and exploded view of the end portion of the lifting boom of the vehicle of FIG. 1, further showing a bucket and bucket liner.

Referring to FIG. 2, platform 26 is shown as a "bucket" type platform, generally including an outer bucket 28 and an internal bucket liner 30 received within bucket 28. Bucket 28 may be made of a dielectric or electrically conductive material, such as fiberglass, plastic, or a metal or metal alloy, for example, with suitable materials including carbon fiber, aluminum, and steel. Bucket 28 includes front wall 30*a*, rear wall 30*b*, left wall 30*c*, right wall 30*d*, and bottom wall 32 which together provide bucket 28 with a generally rectilinear configuration having an open upper end and an open interior 34. Bucket 28 may additionally have an upper edge 36 corresponding to the upper ends of its side walls, namely, front wall 30*a*, rear wall 30*b*, left wall 30*c*, and right wall 30*d*, which may optionally be configured as a horizontal upper lip or flange extending around upper edge 36 of bucket 28.

In the bucket construction depicted in FIG. 2, rear wall 30*b* of bucket 28 includes a rigid boom mount plate 38, typically made of a high strength metal or metal alloy, embedded within the material of rear wall 30*b* and/or attached exteriorly to wall 30*b*. Boom mount plate 38 includes a boom attachment structure shown as a series of fixation points 40 which, for example, may be threaded apertures within, or bolts extending from, boom mount plate 38. The end of boom arm 24 includes a corresponding mount plate 42 having a corresponding series of fixation points 44 for securement to the fixation points 40 of mount plate 38 of bucket 28. However, as will be apparent from the discussion below, the particular manner in which bucket 28 is secured to the end of boom arm 24 may vary depending on the particular structure of boom assembly 22, and the present anchor assembly is not limited to any particular type of securement mechanism between bucket 28 and the end of boom arm 24. Further, as also discussed below, the present anchor assembly is retro-fittable onto any type of aerial lift platform regardless of the particular interface used to connect the platform and the boom.

In a first embodiment, a rigid anchor plate 46, typically made of a high strength metal or metal alloy, and having a hole or aperture 48 for fixation of the present anchor assembly, may also be embedded within the material of rear wall 30*b* of bucket 28. Anchor plate 46 may be separate from, or may be an integral part of, boom mount plate 38. Alternatively, anchor plate 46 may be embedded within, or otherwise associated with, any of front wall 30*a*, left wall 30*c*, right wall 30*d*, or bottom wall 32 of bucket such that, as described further below, the location of the present anchor assembly with respect to bucket 28 may vary.

Bucket liner 30 is received within bucket 28 and, similar to bucket 28, also includes front wall 50*a*, rear wall 50*b*, left wall 50*c*, right wall 50*d*, and bottom wall 52 which together provide liner 30 with a generally rectilinear configuration having an open upper end and an open interior 54, which is complementary to the shape of bucket 28 such that liner 30 may be received within bucket 28, typically via a substantially close fit. Liner 30 may additionally have an upper edge 56 corresponding to the upper ends of it side walls, namely, front wall 50*a*, rear wall 50*b*, left wall 50*c*, and right wall 50*d*, which may optionally be configured as a horizontal upper lip or flange extending around upper edge 56 of liner 30, and which may be shaped in a complementary manner to interface with the upper edge 36 of bucket 28. Rear wall 50*b* includes a hole or aperture 58 though, as described below, hole or aperture 58 may be located elsewhere on any other wall of liner 30. In particular, hole or aperture 58 may be alternatively located in front wall 50*a*, left wall 50*c*, right wall 50*d*, or bottom wall 52, with the corresponding hole or aperture of bucket liner 30 aligned therewith, as described below and shown in FIG. 4. Liner 30 is made of a dielectric material, such as fiberglass or a plastic such as polyethylene.

Although bucket 28 and liner 30 are shown and described herein as having a rectilinear shape, the particular shapes of bucket 28 and liner 30 are not critical, and bucket 28 and liner 30 may have other shapes, such as round or oval, and it will be apparent from the present disclosure that the anchor assembly of the present disclosure may be used with buckets and liners having shapes other than rectilinear.

Figure 3:
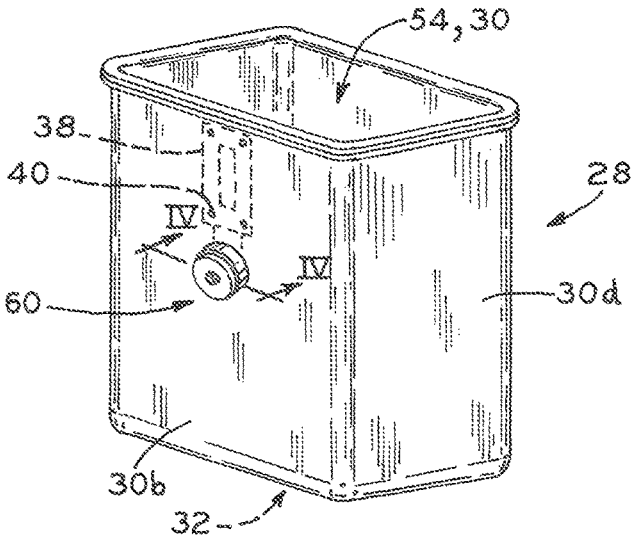
FIG. 3 is a perspective view of the bucket and bucket liner of FIG. 2, including an anchor assembly according to the present disclosure.
Figure 4:
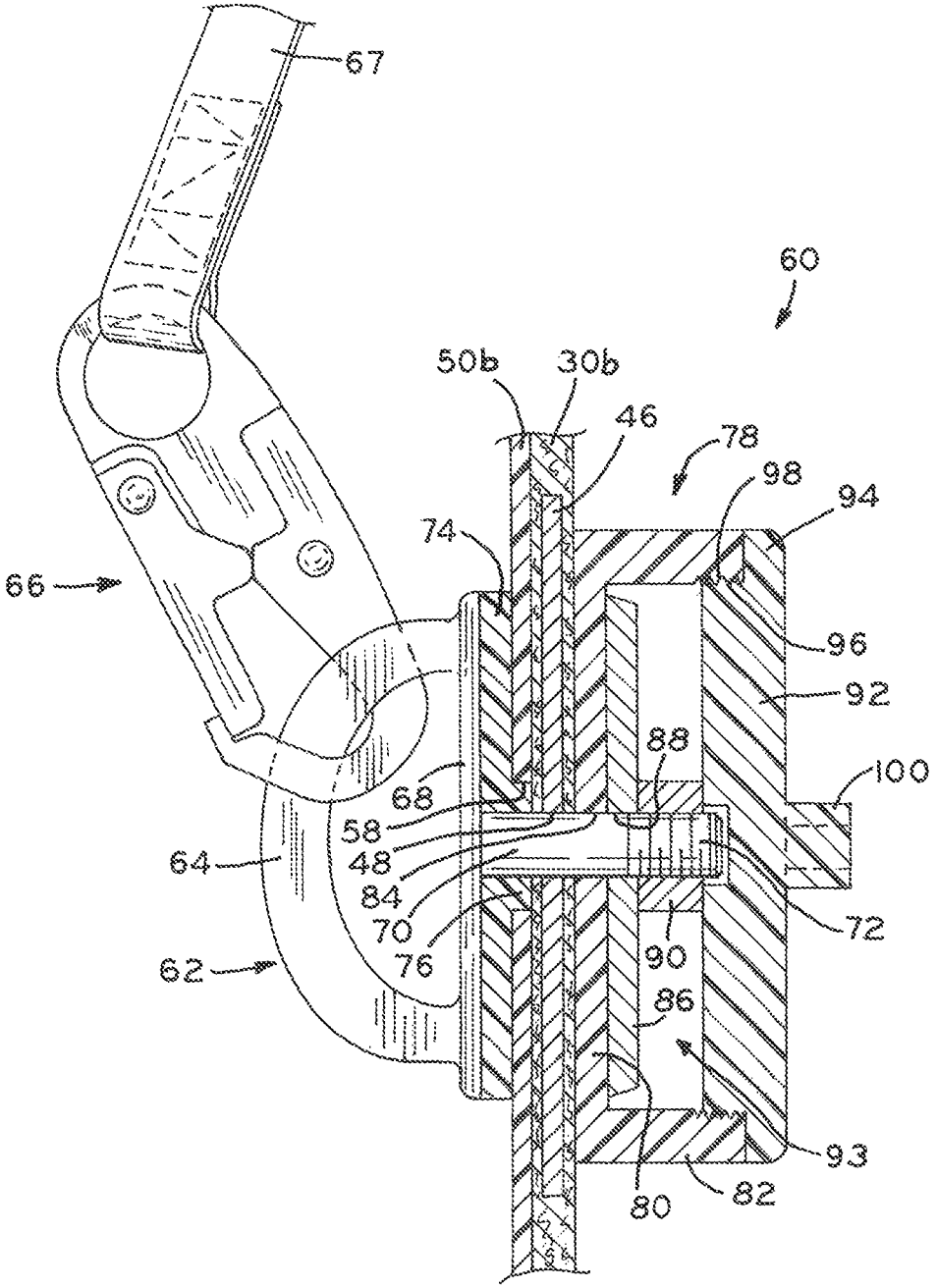
FIG. 4 is a sectional view taken along line 4-4 of FIG. 3, further showing a clasp and a portion of a harness assembly.
Figure 5:
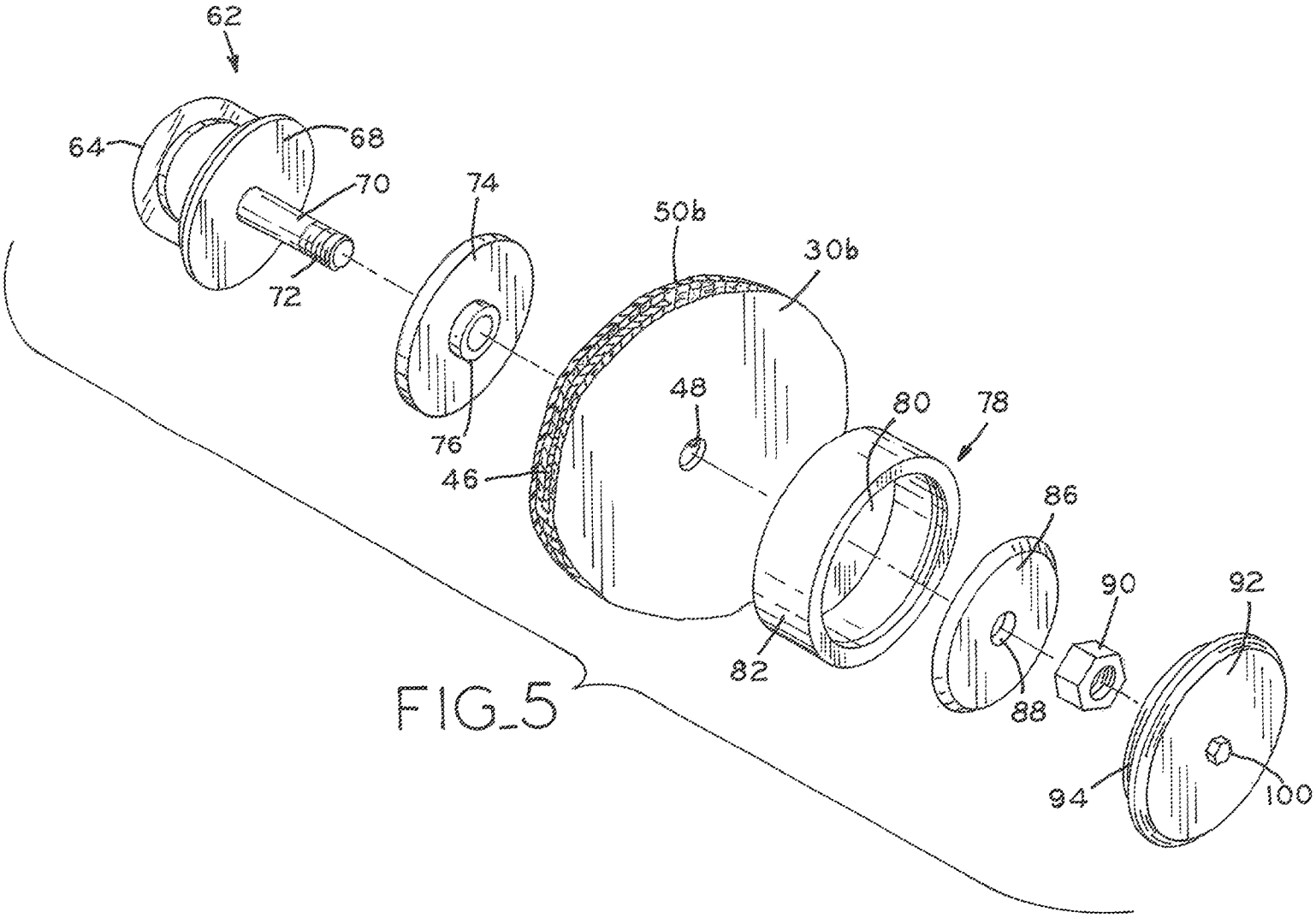
FIG. 5 is an exploded view of components of the dielectric anchor assembly of FIGS. 3 and 4.

Referring to FIGS. 3-5, an anchor assembly 60 in accordance with a first embodiment of the present disclosure is shown, which generally includes a rigid anchor point disposed within the interior 54 of liner 30, as well as a cover assembly disposed externally of bucket 28. The anchor point of anchor assembly 60 generally provides a firm anchoring or fixation point for securing a clip fastener or other attachment structure associated with a harness assembly that may be worn by a worker positioned within the aerial platform 26. The cover assembly provides a dielectric cover or protective enclosure for anchor assembly 60 externally of bucket 28 in order to isolate any electrically conductive components of anchor assembly 60 from the environment externally of platform 26, as also discussed further below.

Referring to FIGS. 4 and 5, with liner 30 received within bucket 28, rear wall 50*b* of liner 30 is disposed adjacent rear wall 30*b* of bucket 28, with the forgoing walls either in direct contact with one another as shown in FIG. 4, or alternatively, spaced very closely adjacent one another with a small air gap space between rear wall 50*b* of liner 30 and rear wall 30*b* of bucket 28.

Anchor member 62 is made of a rigid material, such as a metal or metal alloy or a rigid plastic, for example, and includes an anchor ring 64 to which a clip 66 (FIG. 4) of a harness assembly 67 of the type worn by a user may be secured. Anchor member 62 also includes anchor plate 68 and shaft 70 having a threaded end 72. An optional internal insulating pad 74, made of a dielectric material such as plastic or rubber, for example, may be disposed between anchor plate 68 and the interior surface of rear wall 50*b* of liner 30, and may further include an annular boss portion 76 disposed between the interior of hole 58 in rear wall 50*b* of liner 30 and shaft 70 of anchor member 62. Shaft 70 extends through holes 48 and 58 in rear walls 32*b* and 50*b* of bucket 28 and liner 30, respectively.

An insulating housing 78 is disposed on the exterior side of rear wall 30*b* of bucket 28, and is formed as a cup-shaped member including a bottom wall 80, a cylindrical side wall 82, and a central hole or aperture 84. Housing 78 is made of a dielectric material, such as a rigid plastic, for example. An optional external anchor plate 86 is disposed within housing 72, and includes a central hole 88 such that anchor plate 86 may be received over the threaded end 72 of shaft 70 of anchor member 62. External anchor plate 86 may be made of a suitable metal, metal alloy, or a rigid plastic, for example. Optionally, an insulating pad (now shown) similar or identical to insulating pad 74, may be disposed between rear wall 30*b* of bucket 28 and housing 78. A metal or rigid plastic retaining device, such as a nut 90, is threaded over the threaded end 72 of shaft 70 to tightly capture the above-described components against one another in a multilayer structure.

Specifically, tightening of nut 90 draws the above-described components tightly together in the manner shown in FIG. 4, with internal anchor plate 68 of anchor member 62 and internal insulating pad 74 tightly and sealingly pressed against the interior surface of rear wall 50*b* of liner 30, and housing 78 and external anchor plate 86 tightly and sealingly pressed against the exterior surface of rear wall 30*b* of bucket 28. The foregoing assembly forms a rigidified anchoring construction in which there are no fluid pathways present between the interior 54 of liner 30 and the environment outside of bucket 28. In this manner, the interior 54 of liner 30 is electrically insulated from the environment outside of bucket 28.

Housing cover 92 is made of a dielectric material, such as a rigid plastic, and includes a side wall 94 having exterior threads 96 for threaded engagement with interior threads 98 of cylindrical wall 82 of insulating housing 78. Cover 92 includes an integral tool fitting, such as a projecting hex nut 100, for example, which may be engaged by a suitable tool for installing cover 92 onto housing 78 or removing cover 92 from housing 78. When cover 92 is secured in place, any metallic components of anchor assembly 60 that are disposed on the exterior side of bucket 28, such as shaft 70, external anchor plate 86, and nut 90, are electrically insulated or sealed from the environment outside of bucket 28. Also, an insulating air space 93 may be present in an interior of housing 78 when cover 92 is attached to housing 78 as described above.

In this manner, anchor assembly 60 provides a rigid anchor point within a wall of bucket 28 and liner 30, which is exposed within the interior 54 of liner 30 for securement of the harness assembly of an operator, wherein all of the metallic components of anchor assembly 60 are electrically insulated from the environment outside of bucket 28. Also, anchor assembly 60 provides a secure connection between bucket 28 and liner 30, preventing liner 30 from being ejected from bucket 28.

Notably, the present anchor assembly 60 was developed in contravention to the existing design knowledge in the art, in which known anchor assemblies have avoided any type of hole or aperture in any of the side walls or bottom wall of the bucket or bucket liner. Stated otherwise, conventional anchoring structures known in the art were specifically developed to maintain the complete structural integrity of the side walls and the bottom wall of the bucket and bucket liner. This approach was previously thought necessary for a bucket liner to pass existing electrical integrity tests used in the art, such as ANSI A92.2 sections 4.94, 5.4.2.5, and/or 5.4.2.5 (2009), in which a bucket liner is submerged within a water tank such that the depth of the water is within about 6 inches from the upper lip of the bucket liner, both outside and inside of the liner. In this manner, the water inside the liner is nominally electrically isolated from the water outside of the bucket liner. An electrical current is then provided to the water within the tank and outside of the bucket liner, with a meter disposed within the interior of the bucket liner to determine whether any electrical current passes from the water in the tank outside of the bucket liner to the water in the interior of the bucket liner. In a successful test, current leakage recorded by the meter remains below a specified value, indicating the dielectric integrity of the bucket liner. In an unsuccessful test, current leakage recorded by the meter exceeds a specified value, indicating a failure in the dielectric integrity of the bucket liner, which may be due to cracks or fissures in a wall of the bucket liner, for example.

Advantageously, despite the presence of hole 58 in liner 30 with which anchor assembly 60 is used, the foregoing dielectric integrity test may be met by a bucket liner including the anchor assembly of the present disclosure. Specifically, for testing the liner 30, anchor assembly 60 may be disassembled by removing housing cover 92 and nut 90, followed by removal of the remaining components of anchor assembly 60 from bucket 28 and liner 30, such that liner 30 may itself be removed from bucket 28. Following removal of liner 30 from bucket 28, anchor assembly 60 may be reassembled to liner 30 in the manner described above through hole 58 about the internal and exterior surfaces of the wall of liner 30, followed by placing liner 30 within a water tank according to the above-described test. In this manner, the testing configuration of liner 30 and its anchor assembly 60 is identical to that of the installed configuration shown in FIG. 4, only without the presence of the wall 30*b* of bucket 28 and the harness assembly 67 and its clip 66. During the test, external insulating housing 78 and housing cover 92 electrically isolate any metallic components of anchor assembly 60 from the water in the tank to prevent the passage of electric current from the water in the tank through liner 30 and into the interior 54 of liner 30.

Figure 6A:
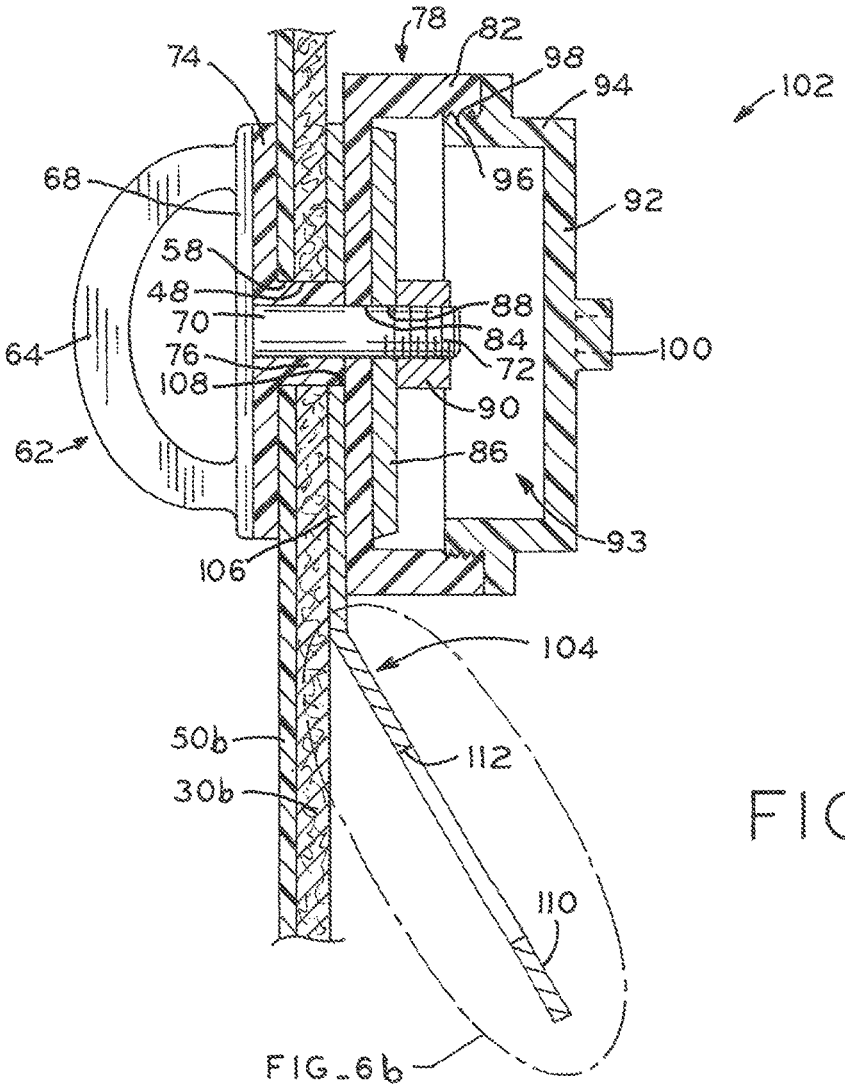
FIG. 6A is a further sectional view of a dielectric anchor assembly, corresponding to the location of line 4-4 of FIG. 3, showing a modified bucket.
Figure 6B:
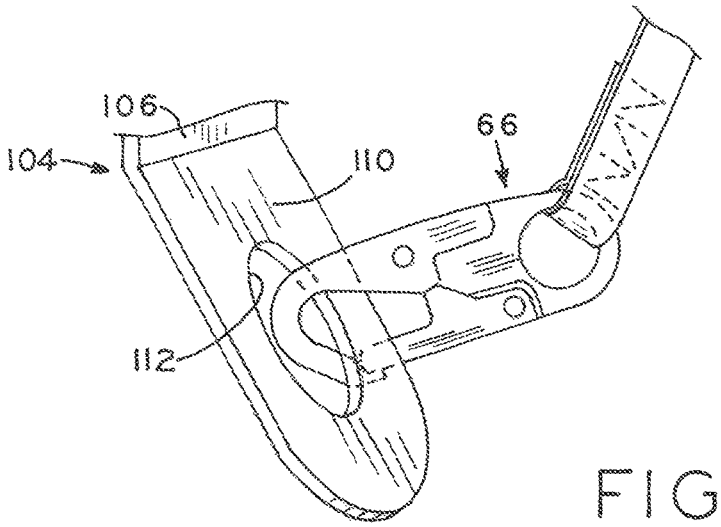
FIG. 6B is a fragmentary perspective view of a portion of FIG. 6A.

Referring to FIGS. 6A and 6B, an anchor assembly 102 according to a further embodiment of the present disclosure is shown. Except as described below, the components of anchor assembly 102 are identical or substantially identical to those of anchor assembly 60, and identical reference numerals will be used to designate such identical or substantially identical components. A secondary anchor plate 104 is secured to the exterior and/or interior side of rear wall 30*b* of bucket 28, which includes an upper portion 106 having a hole or aperture 108 therein for receipt of anchor assembly 102, as well as a lower portion 110 which may be disposed at an angle relative to upper portion 106, and which includes an external anchor plate in the form of a hole or aperture 112. A connection device, such as a chain or fabric webbing, may be secured to hole 112 in lower portion 110 of external anchor plate 104 to secure same to boom arm 24 (FIG. 2). Alternatively, secondary anchor plate may be secured to another wall of bucket 28, such as front wall 30*a*, left wall 30*c*, right wall 30*d*, or bottom wall 32

Advantageously, as may be seen in connection with each of the embodiments of the anchor assemblies described above, the anchor assemblies may be retro-fittable onto any existing platform structure, regardless of the specific connection mechanism that is used to secure the platform 26 to the boom arm 24, such as by forming a hole through the walls of an existing bucket liner and/or bucket. Additionally, the location of the anchor assembly on the platform 26 may vary widely. For example, anchor assembly 60 or 102 may be disposed at substantially any location within the side walls of the bucket and bucket liner, or even in the bottom wall of the bucket and bucket liner.

In one embodiment, the anchor assembly is mounted to the platform 26 in a manner in which the anchor ring 64 or the shaft 70 of anchor member 62 is disposed adjacent upper edge 56 of bucket liner 30 or, in another embodiment, is disposed at least 6 inches from upper edge 56 in a direction from upper edge 56 toward bottom wall 52. In a still further embodiment, the anchor ring 64 or the shaft 70 of anchor member 62 may be disposed at least 30 inches from bottom wall 52 in a direction from bottom wall 52 toward upper edge 56 of liner 30, such as between 39 and 42 inches from bottom wall 52 in a direction from bottom wall 52 toward upper edge 56 of liner 30, for example.

Still further, although the embodiment of FIGS. 3-5 shows anchor assembly 60 including a metal anchor plate 46 embedded within a wall of bucket 28, and the embodiment of FIGS. 6A and 6B includes an external anchor plate 104 secured to a side wall of bucket 28, in a further embodiment, such plates could be eliminated such that the anchor assembly is positioned at any desired location within any side wall or bottom wall of bucket 28 and liner 30 by forming aligned holes at a desired location within the side wall or bottom wall, followed by installing the anchor assembly at such location in manner described above.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A platform for use with an aerial lift vehicle, comprising:

a bucket including a first bottom wall and at least one first side wall, and a first hole in one of said first bottom wall and said first side wall;

a bucket liner received within said bucket, said bucket liner including a second bottom wall and at least one second side wall, and a second hole in one of said second bottom wall and said second side wall, said second hole in alignment with said first hole; and an anchor assembly extending through said first and second holes, said anchor assembly comprising:

an internal anchor disposed internally within said bucket liner; and a cover assembly disposed externally of said bucket, said cover assembly made of a dielectric material and covering a portion of said anchor assembly which extends externally of said bucket to electrically isolate said internal anchor from an environment external of said bucket.

2. The platform of claim 1, wherein said first hole is in said first side wall of said bucket, and said second hole is in said second side wall of said bucket liner, said first and second side walls together being one of front walls, rear walls, left walls and right walls.

3. The platform of claim 1, wherein said anchor assembly further comprises an anchor member including said internal anchor and a shaft, said shaft extending through said first and second holes, and said cover assembly further comprises a housing disposed externally of said bucket, said housing receiving an end of said shaft.

4. The platform of claim 3, wherein said cover assembly further comprises a cover attached to said housing, said cover and said housing each made of a dielectric material for electrically insulating said shaft end from an environment external of said bucket.

5. The platform of claim 3, wherein said shaft end is threaded, and said anchor assembly further includes a nut threaded onto said threaded end of said shaft to draw said internal anchor, said side wall of said bucket liner, said side wall of said bucket, and said housing together with no electrically conductive paths present between an interior of said bucket liner and the environment external of said bucket.

6. The platform of claim 3, further comprising an anchor plate including a hole through which said shaft is received, said anchor plate one of embedded within said first side wall of said bucket or disposed on an external side of said first side wall of said bucket.

7. The platform of claim 3, further comprising an external anchor plate captured between said side wall of said bucket and said housing, said external anchor plate including an external anchor disposed externally of said housing.

8. The platform of claim 1, further comprising an insulating pad disposed between said internal anchor and said side wall of said bucket liner.

9. The platform of claim 1, wherein said at least one side wall of said bucket liner defines an upper edge disposed opposite said bottom wall of said bucket liner, said internal anchor disposed beneath said upper edge in a direction from said upper edge toward said bottom wall of said bucket liner, and said internal anchor disposed at least 6 inches beneath said upper edge in a direction from said upper edge toward said bottom wall of said bucket liner.

10. A platform for use with an aerial lift vehicle, comprising:

a bucket including a first bottom wall and at least one first side wall, and a first hole in one of said first bottom wall and said first side wall;

a bucket liner received within said bucket, said bucket liner including a second bottom wall and at least one second side wall, and a second hole in one of said second bottom wall and said second side wall, said second hole in alignment with said first hole; and an anchor assembly extending through said first and second holes, said anchor assembly comprising:

an internal anchor disposed internally within said bucket liner, said internal anchor including a shaft extending through said aligned first and second holes, said shaft having an end disposed externally of said bucket; and a cover assembly made of a dielectric material and covering said shaft end whereby said internal anchor is electrically isolated from an environment external of said bucket.

11. The platform of claim 10, wherein said first hole is in said first side wall of said bucket, and said second hole is in said second side wall of said bucket liner, said first and second side walls together being one of front walls, rear walls, left walls and right walls.

12. The platform of claim 10, wherein said cover assembly includes a housing disposed externally of said bucket liner and receiving said shaft.

13. The platform of claim 12, wherein said cover assembly further comprises a cover attached to said housing, said cover and said housing each made of a dielectric material for electrically insulating said shaft end from the environment external of said bucket.

14. The platform of claim 10, wherein said shaft includes a threaded end, and said anchor assembly further includes a nut threaded onto said threaded end of said shaft to draw said internal anchor, said side wall of said bucket liner, said side wall of said bucket, and said nut together with no electrically conductive paths present between an interior of said bucket liner and the environment external of said bucket.

15. The platform of claim 10, wherein at least one said second side wall of said bucket liner defines an upper edge disposed opposite said bottom wall of said bucket liner, said internal anchor disposed beneath said upper edge in a direction from said upper edge toward said bottom wall of said bucket liner, and said internal anchor disposed at least 6 inches beneath said upper edge in a direction from said upper edge toward said bottom wall of said bucket liner.

16. A bucket liner for use with a platform of an aerial lift vehicle, comprising:

a bottom wall and at least one first side wall, and a hole extending entirely through one of said bottom wall and said side wall; and an anchor assembly extending entirely through said hole, said anchor assembly comprising:

an internal anchor disposed within said bucket liner; an external component disposed externally of said bucket liner; and a cover assembly disposed externally of said bucket liner, said cover assembly made of a dielectric material and covering said external component whereby said internal anchor is electrically isolated from an environment external of said bucket liner.

17. The bucket liner of claim 16, wherein said hole is in said side wall of said bucket liner, said side wall being one of a front wall, a rear wall, a left wall and a right wall.

18. The bucket liner of claim 16, wherein at least one said first side wall of said bucket liner defines an upper edge disposed opposite said bottom wall of said bucket liner, said internal anchor disposed beneath said upper edge in a direction from said upper edge toward said bottom wall, and said internal anchor disposed at least 6 inches beneath said upper edge in a direction from said upper edge toward said bottom wall.

19. The bucket liner of claim 16, wherein said bucket liner also includes a second side wall, a front wall, and a rear wall, wherein said first and second side walls, said bottom wall, said front wall and said rear wall together define a rectilinear configuration.

20. The bucket liner of claim 16, wherein said internal anchor includes a shaft with a threaded end, and said anchor assembly further includes a nut threaded onto said threaded end of said shaft to draw said internal anchor, said side wall of said bucket liner, and said nut together with no electrically conductive paths present between an interior of said bucket liner and the environment external of said bucket liner.

* * * * *